US011072939B2

(12) United States Patent
Dautaj et al.

(10) Patent No.: US 11,072,939 B2
(45) Date of Patent: Jul. 27, 2021

(54) EATERY

(71) Applicant: Hamza Mutevelic, Vienna (AT)

(72) Inventors: Gazmend Dautaj, Vienna (AT); Hamza Mutevelic, Vienna (AT)

( * ) Notice: Subject to any disclaimer, the term of this patent is extended or adjusted under 35 U.S.C. 154(b) by 0 days.

(21) Appl. No.: 14/901,429

(22) PCT Filed: Sep. 12, 2013

(86) PCT No.: PCT/AT2013/000150

§ 371 (c)(1),
(2) Date: Dec. 28, 2015

(87) PCT Pub. No.: WO2014/205462

PCT Pub. Date: Dec. 31, 2014

(65) Prior Publication Data

US 2016/0138290 A1 May 19, 2016

(30) Foreign Application Priority Data

Jun. 27, 2013 (AT) ..... A 529/2013

(51) Int. Cl.

| | |
|---|---|
| ***E04H 1/12*** | (2006.01) |
| ***E04H 3/02*** | (2006.01) |
| ***E04H 12/18*** | (2006.01) |
| ***E04B 1/34*** | (2006.01) |
| ***E04B 1/343*** | (2006.01) |

(52) U.S. Cl.

CPC ..... *E04H 12/182* (2013.01); *E04B 1/34363* (2013.01); *E04H 1/1222* (2013.01); *E04H 3/02* (2013.01)

(58) Field of Classification Search

CPC ..... E04H 12/182; E04H 3/02; E04H 1/12; E04H 1/1222; E04H 1/1205; E04H 3/00; E04H 9/145; E04B 1/3465; E04B 1/346; E04B 1/3404; E04B 1/3408; E04B 1/3412; E04B 1/3416; E04B 1/34336; E04B 1/34352; E04B 1/34363

See application file for complete search history.

(56) References Cited

U.S. PATENT DOCUMENTS 3,125,189 A * 3/1964 Graham ..... E04B 1/346 52/65
3,246,431 A * 4/1966 Leopold Faerber .... E04B 1/346 52/65
3,388,512 A * 6/1968 Newman ..... E04B 1/3404 52/125.2
3,408,777 A * 11/1968 Ghirelli ..... E04B 1/3465 52/1

(Continued)

FOREIGN PATENT DOCUMENTS

CN 106401258 A * 2/2017
DE 2026714 A1 1/1972

(Continued)

*Primary Examiner* — Ryan D Kwiecinski

(74) *Attorney, Agent, or Firm* — Christopher Mayle; Bold IP, PLLC

(57) ABSTRACT

The invention relates to an eatery having at least one table element and at least one seating element, a moveable and accessible platform on which the at least one table element and at least one seating element are arranged, is provided. At least one elevation device for raising the platform is arranged in the area below the platform.

6 Claims, 4 Drawing Sheets

(56) References Cited

U.S. PATENT DOCUMENTS 3,546,827 A 12/1970 Demarais
3,600,865 A * 8/1971 Vanich ..... E04B 1/3404 52/223.4
3,895,473 A * 7/1975 Fraser ..... E04B 1/3511 52/745.04
3,895,495 A * 7/1975 Akazaki ..... B63B 35/44 114/66
3,905,166 A * 9/1975 Kaiser ..... E04B 1/3465 52/65
3,922,827 A * 12/1975 Rosenblatt ..... E04H 5/12 52/245
3,943,671 A * 3/1976 Curci ..... E04B 1/3408 52/69
4,817,345 A * 4/1989 McGIew ..... E04B 1/346 52/64
5,918,424 A * 7/1999 Rice ..... E04B 1/3465 137/580
5,974,743 A * 11/1999 Vaia ..... E04H 9/02 52/169.6
6,457,280 B1 * 10/2002 Park ..... E03C 1/00 52/65
7,562,496 B2 * 7/2009 Zwiebach ..... E04B 1/34363 52/30
7,766,754 B2 * 8/2010 Davison, Jr. ..... G09F 15/00 40/427
7,978,055 B2 * 7/2011 Garcia ..... A47B 37/00 340/286.09
7,992,350 B2 * 8/2011 Vriens ..... E04B 1/3412 52/40
8,302,357 B1 * 11/2012 Nolte ..... E02D 31/002 52/294
8,696,479 B2 * 4/2014 Marks ..... E04H 12/00 472/131
8,973,309 B2 * 3/2015 Amir ..... E04H 12/10 52/40
10,365,062 B2 * 7/2019 Oesch ..... E04H 12/20
10,753,080 B1 * 8/2020 Houston ..... E04B 1/3404
2013/0065699 A1 * 3/2013 Michaels ..... A63G 1/30 472/39
2013/0220133 A1 * 8/2013 Plutshack ..... C12C 13/00 99/276
2016/0138290 A1 * 5/2016 Dautaj ..... E04H 12/182 52/67
2019/0137084 A1 * 5/2019 Kim ..... F21V 29/60

FOREIGN PATENT DOCUMENTS

DE 2304901 A1 8/1973
DE 20 2006 006 988 U1 8/2006
DE 102017114090 A1 * 12/2018 ..... E04B 1/3516
EP 2813644 A2 * 12/2014 ..... E04H 1/1205
FR 2580708 A1 * 10/1986 ..... B66F 7/0633
GB 1153249 A * 5/1969 ..... E04H 12/18
WO 2004/057132 A2 7/2004
WO 2007/059947 A1 5/2007
WO 2009/077792 A1 6/2009

* cited by examiner

EATERY

The invention relates to an eatery having at least one table element and at least one seating element.

Open-air eating areas, such as beer gardens or sidewalk eateries, are a widely popular extension of food service businesses in warm seasons, albeit in many places compromised by sound and pollutant effects, such as in the form of exhaust gas or particles. An additional drawback is the relative exposition to observations by persons present or passing as well as interference by weather as it can sometimes occur.

It is thus a task of the invention to provide an eatery of the kind initially mentioned, which provides protection against the external influences listed above along with the possibility of unhindered service and conversation among guests as well as air conditioning.

According to the invention, this is achieved by providing a moveable and accessible platform, on which the at least one table element and the at least one seating element are arranged, with at least one elevation device for raising the platform being arranged in the area below the platform.

The core of the invention is thus the platform moveable in height, which can be set up without requiring much space, for example, in the beer garden of a food service business, and which can be placed in an area offset in height as compared to ground level, in which little or no external interference will occur, such that guests can spend their stay at the premises undisturbed by passing persons or vehicles. In addition, the platform provides further possibilities of shielding against external influences, such as pollutant emissions, noise or the weather, including wind, snow, or rain.

The eatery according to the invention is a delimited area, which can be raised and placed, for example, outside a restaurant even at a busy street, protecting a guest or group of guests from the immediate influences of street level.

Guest service may be via a restaurant located in the immediate proximity, but also on self-service units arranged on the platform, such as drinks or food dispensers. If an order is placed to the adjacent restaurant, the service personnel will bring the order to the platform, which can be lowered for this purpose.

Should persons stay on the platform without consuming anything, it cannot be raised, or is lowered. Only when an order is placed does the possibility of utilizing the service become active. When no orders have been placed within a certain time span, the platform is lowered automatically.

In a particularly preferred manner, the platform is moveable between a basic position on ground level and a lookout position elevated as compared to ground level, such that guests staying on the platform are able to observe the environment without structural obstruction.

In another embodiment of the invention, the platform can be rotatable around a vertical axis, allowing guests the pleasure of a panoramic view of the environment.

According to another embodiment of the invention, an at least partially closed cabin space can be disposed on the platform, in which the at least one table element and the at least one seating element are included.

A stay inside the cabin space provides protection against external influences such as heat, rain, wind, or snow with the option to perform respective air conditioning inside the cabin space by cooling and heating as well as inlet and outlet air devices. Inlet and outlet of air or heating or cooling media, respectively, can be via tubes that can, for example, partially be directed into the cabin space within the elevation device.

Individually placed platforms in an external area without a restaurant may have a heat/climate pump integrated into the platform. Additional electricity supply via solar or photovoltaic systems may be provided for more southern regions with a large number of sunny days.

The table element located on the platform may include other functions in addition to the food service purpose; for example, the table element may include a touchscreen 401 integrated into the table surface. That way, guests will have a large screen or several displays at their disposal, on which, for example, the food and drinks menu can be displayed.

Payment can be placed with the service personnel or on the platform via bankcard or credit card, or with a dedicated user card.

As an additional service option, guests can also be given the opportunity to have various backgrounds or media images and videos displayed in a glass and/or acrylic glass vault located above the table element upon payment of a fee, such as music videos, news, movies, or making phone calls, as desired according to their personal taste. Also, the platform can have Internet access or a telephone connection.

Another variant of the invention can thus be that the cabin space has a vault-like top and that at least one exterior wall is disposed, on the inside of which the at least one seating element is arranged or integrated.

For safety reasons, and to avoid unauthorized invasion of the cabin space, the cabin space can be enterable via at least one lockable door element.

Furthermore, the platform and/or the cabin space can be closable completely or partially as desired using automatically adjustable sliding doors.

In another embodiment of the invention, the at least one elevation device can be provided with tubes to be pushed in and pulled out telescopically using an elevation drive, by which the platform can be moved in height. In a particularly preferred manner, the elevation device can be formed by a telescopic cylinder to be pushed in and pulled out along a central vertical axis, which is arranged on the ground in an adequately stable manner to be able to move the platform between the street-level position and the elevated position. In the invention, however, other mechanisms can be provided as well to allow moving the platform in height.

For safety reasons, the platform can be surrounded by a cordon in its ground position, which is made, for example, of a wire fence or a safety glass and prevents invasion of the area below the elevated platform. In addition, the two entry areas of the platform can be closed by an automatically closing barrier made of metal when in the elevated position to prevent persons from falling off.

Optionally available privacy glazing of the platform allows for sufficient privacy to prevent undesired gazes from persons passing by outside. The guest, on the other hand, is of course able to observe the outside area if he or she desires.

Furthermore, the invention relates to a beer garden consisting of one or more eateries according to the invention.

The invention will now be explained in detail based on the exemplary embodiment illustrated in the drawings, in which.

Figure 1:
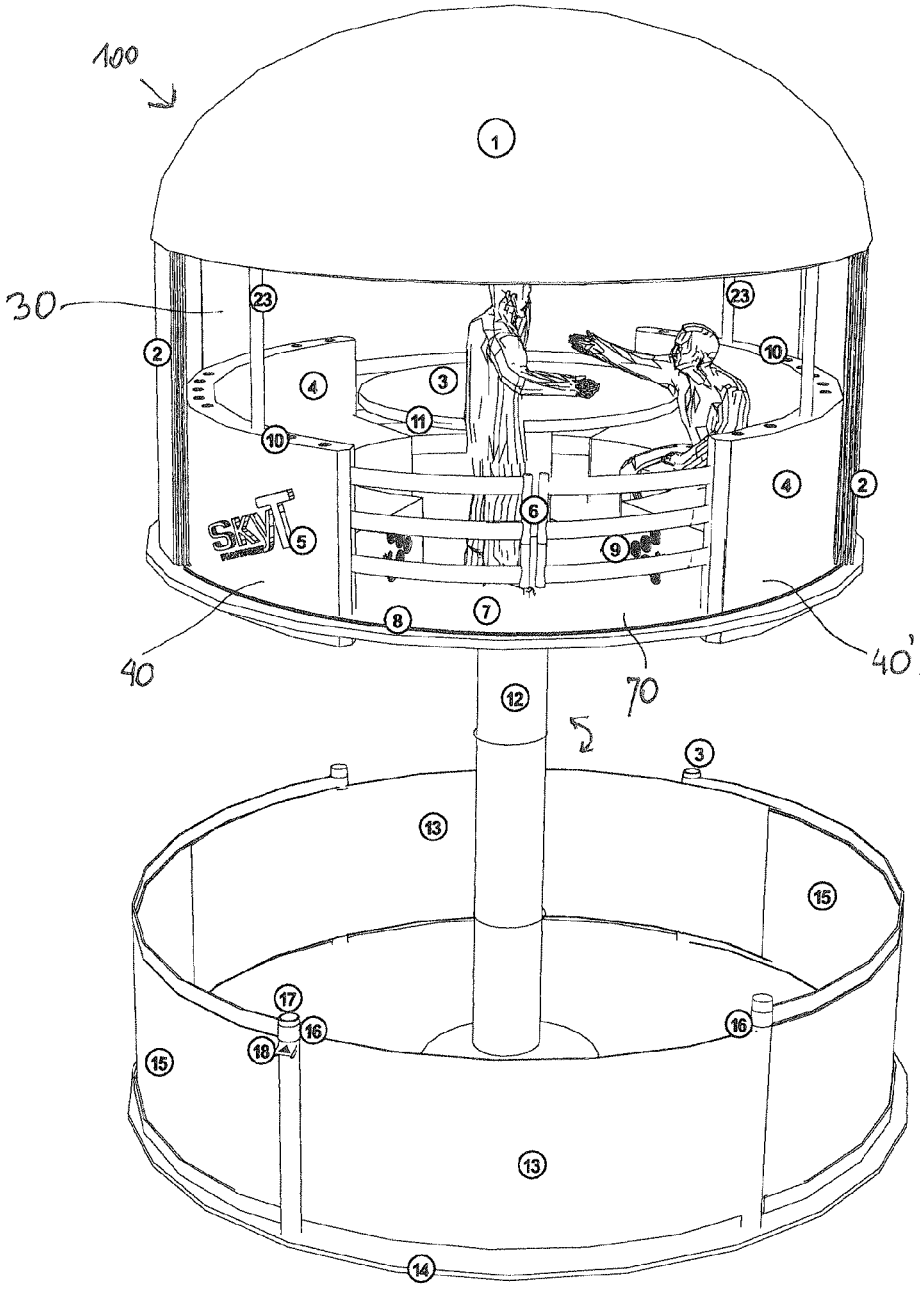
FIG. 1 illustrates an oblique top view of an embodiment of the eatery according to the invention.
Figure 2:
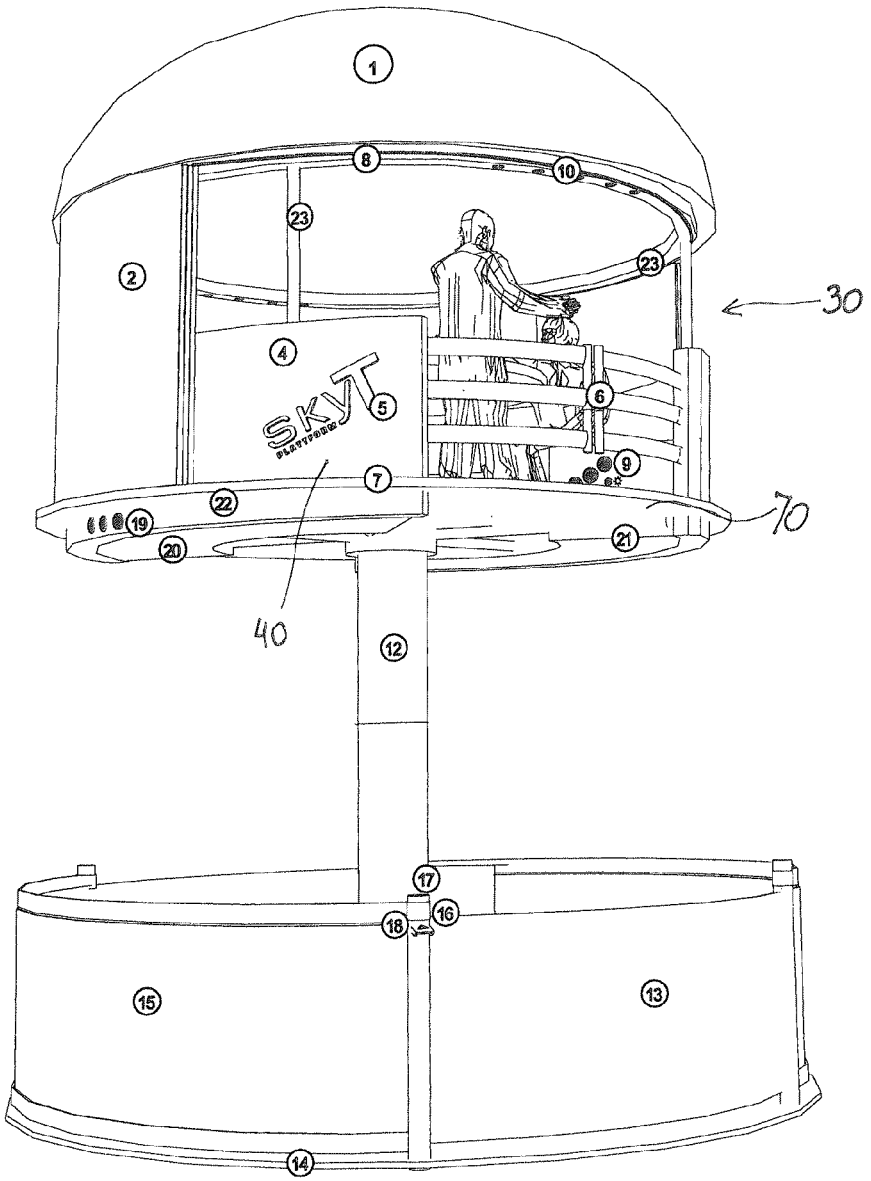
FIG. 2 illustrates an oblique bottom view of the eatery of FIG. 1.
Figure 3:
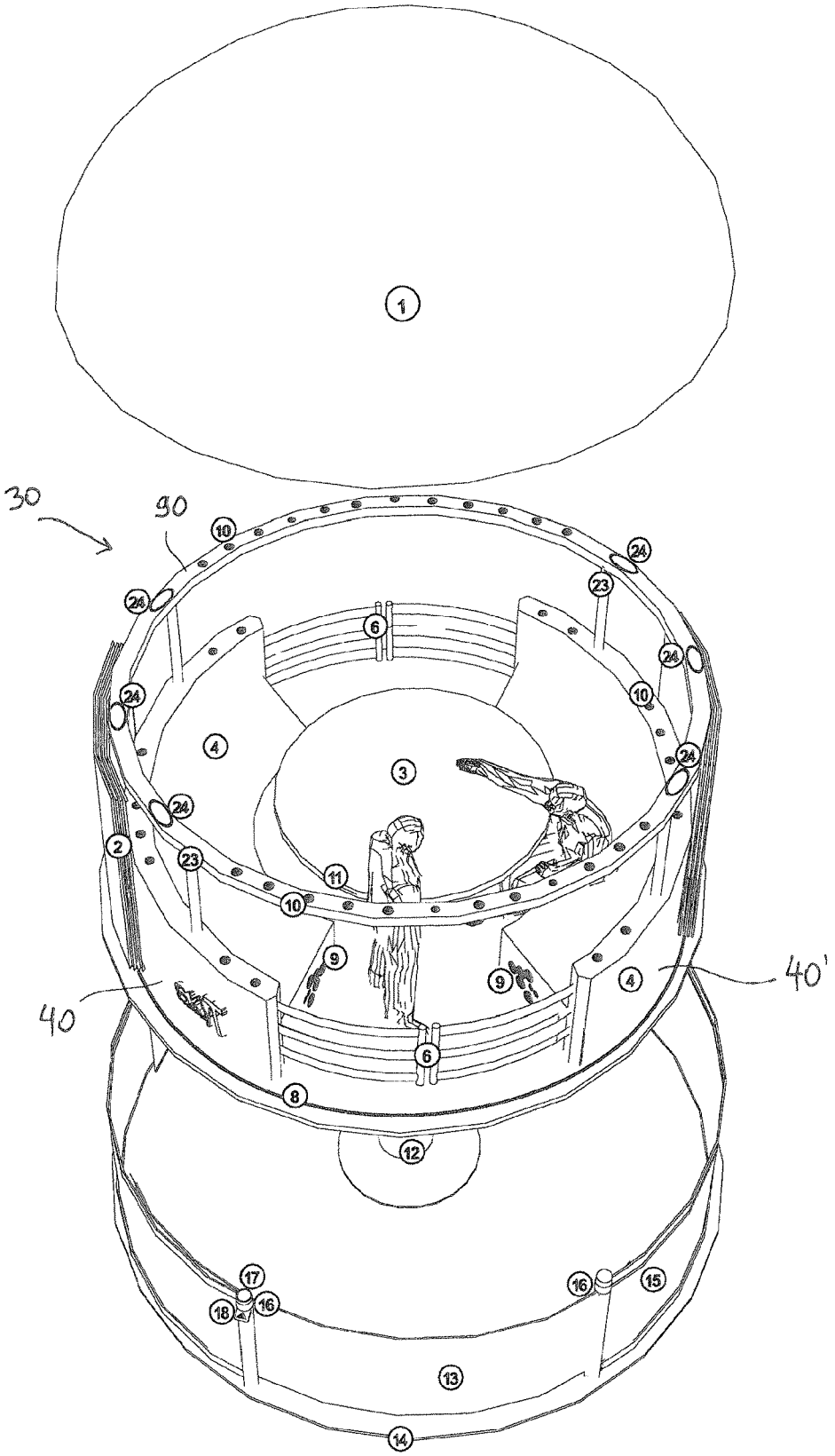
FIG. 3 illustrates an oblique top view of the eatery of FIG. 1 with the vault raised off.

FIGS. 1, 2, and 3 illustrate an eatery 100 for serving and/or entertaining guests having one table element 3 and two seating elements 4, with a moveable and accessible platform 7 being provided according to the invention, on which the one table element 3 and the two seating elements 4 are arranged.

To perform the height movement of the platform 7, an elevation device 12 is arranged in the area below the platform 7.

The platform 7 is moveable between a basic position on ground level and a lookout position at a level elevated as compared to bottom level and rotatable around a vertical axis (curved dual arrow in FIG. 1) corresponding to the central axis of the elevation device 12.

The guests staying on the platform 7 can thus, on the one hand, using the platform 7, be brought to an elevated position in which they sit or stand at a distance from the ground, while on the other hand, rotations of the platform 7 around the vertical axis can be executed by an adequate engine not shown to allow a better view of the environment.

The platform 7 shown in FIGS. 1 through 3 has a polygonal, near-circular platform bottom 70, in the circumferential area of which adequately curved exterior wall elements 40, 40' are provided.

An at least partially closed cabin space 30 is disposed in the platform 7, in which the table element 3 and the two seating elements 4 are included, which are executed as seating benches, the rear wall of which is the respective interior side of each of the two curved opposite exterior wall elements 40, 40'. The openings present in a circumferential direction between their ends can be locked using lockable door elements 6 and be entered through the openings in an opened position of the interior of the cabin space 30. For safety reasons, the pivotable and sliding door elements 6 must not be opened in the lookout position of the platform 7; they are automatically closed when the platform 7 is elevated.

Light fixtures, preferably LED lights 10 to illuminate the cabin space 30 are distributed over the top of the exterior wall elements 40, 40' and the bottom of the vault-like top 1.

Ventilation slots 9 are integrated into the seating area of the seating elements 4, via which adequate air conditioning can take place. To this end, an integrated heating system 20 and an integrated cooling system 21 are provided at the bottom of the platform 7, via which heating and cooling of the cabin space 30 can take place when the sliding door elements 2 are closed.

The table element 3 has a circular tabletop, in which a touchscreen 401 is embedded, from which, for example, control commands can be entered, for example, orders based on a menu, elevating and lowering the platform 7, rotation speed of the platform 7, etc. Both the height movement and the rotation movement of the platform 7 are controllable from the cabin space 30.

Furthermore, automatic control of the movements of platform 7 can be conducted in response to consumption behavior. For example, it can be provided that one hour following the last order placed by a guest, the platform 7 is lowered to its basic position with the door elements being opened to signal that the time of use has ended. The use of a drinks dispenser, which may, for example, be positioned inside the cabin space, or the chargeable booking of a video may, for example, also be regarded as orders.

A credit-card reader unit 11 is incorporated into the table element 3, via which various orders, either in the way of the restaurant services or, for example, in the way of data or video content, can be placed.

In spite of its technological content, the table element 3 is primarily designed for the consumption of food and the consumption of drinks.

The cabin space 30 has a vault-like top 1 made of acrylic glass (PMMA), which is executed to be transparent and thereby allows unimpeded observation of the environment, but also serves as a vaulted projection wall for video and/or data displays as desired. To this end, suitable dimming elements may be provided, which allow for the transparent top 1 to be covered even at times of intense sunlight, for example.

The vault-like top 1 is supported by several struts 23, which are anchored at their bottom ends in the exterior wall elements 40, 40' spaced apart along their circumference and connected at their top ends by an annular member 90 (FIG. 3), in which several loudspeakers 24 are also accommodated distributed along the circumference, which allow for uniform sonication of the cabin space 30.

Window areas are left between the struts 23, through which the environment can be observed.

As shown in FIG. 1 and FIG. 2, one sliding door rail 8 each extends along the outer circumference of the platform bottom 70 and, offset therefrom in height, at the bottom edge of the vault-like top 1 in order to guide transparent sliding door elements 2 along the bottom. While the sliding door elements 2 are depicted in their parallel-telescoped position in FIGS. 1, 2, and 3, they can be moved into their slid-apart position until the entire cabin space 30 is closed by the lined-up sliding door elements 2, such that neither sound not pollutants are able to invade from the outside. Movement of the sliding door elements 2 is conducted via a controllable engine 22 arranged at the bottom of the platform 7.

Outlet air openings 19 are provided to discharge the consumed air (FIG. 2), while heated or cooled fresh air is introduced into the cabin space 30 via slits in the struts 23.

The elevation device 12 is equipped with tubes that can be telescopically pushed in and pulled out using an elevation drive and that can be used to move the platform 7 in height. According to the present exemplary embodiment, the elevation device is formed by a telescopic cylinder 12 that can be pushed in and pulled out along a central vertical axis, the top end of which is attached to the bottom of the platform 7.

At its bottom, the elevation device 12 is connected to a circular stabilizing disc 14 used to secure the platform 7 against tilting.

In its basic position, the platform 7 is surrounded by a cordon 15, e.g. a latticework running circular, which has two opposite openable door areas 13, through which persons can enter the cabin space 30 through the opened door elements 6, as long as the platform 7 is lowered to ground level. A door opener 17 and a door-opener reader unit 18 allow controlling access to the cabin space 30.

Lights 16 mounted to the cordon 15 signal whether the platform is currently used by guests.

Figure 4:
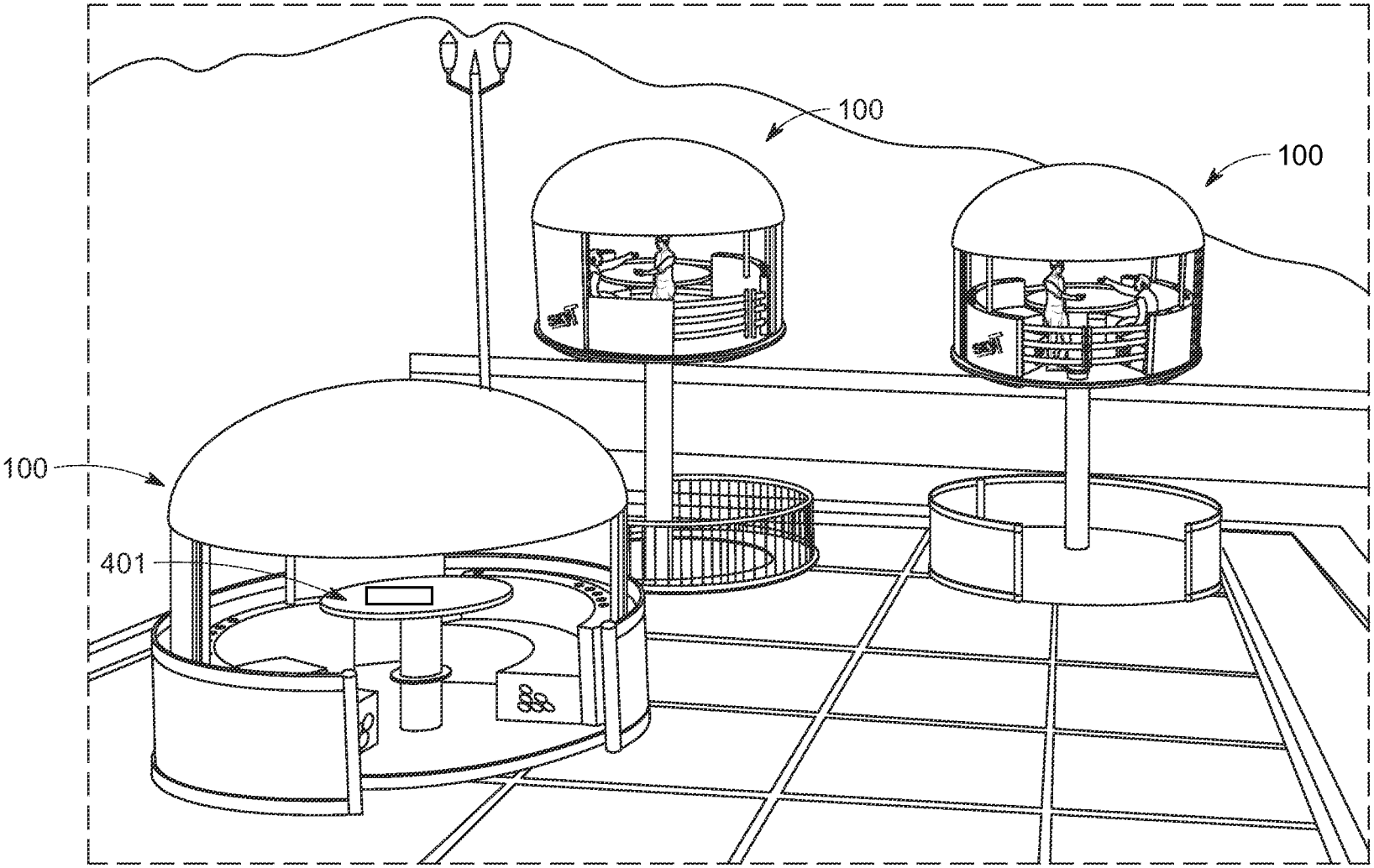
FIG. 4 illustrates an oblique view of a beer garden having several eateries according to the invention.

FIG. 4 illustrates a beer garden, in which three eateries 100 according to the invention are arranged.

I claim:

1. An eatery having a seating area, the seating area having at least one table element and at least one seating element, wherein a moveable and accessible platform, on which the at least one table element and the at least one seating element are arranged, is provided, and wherein at least one elevation device for raising the platform is arranged in the area below the platform, wherein the platform is moveable between a basic position on ground level and a lookout position at a level elevated as compared to ground level, the eatery having a top supported by a plurality of struts which are anchored at their bottom ends in exterior wall elements, the plurality of struts spaced apart along a circumference of the platform and connected at their top ends by an annular member, wherein window areas are positioned between the plurality of struts; the platform having an integrated cooling and heating system wherein ventilation slots are integrated into a seating area of the at least one seating element.

2. The eatery according to claim 1, wherein the annular member is configured to accommodate a plurality of loudspeakers.

3. The eatery according to claim 1, wherein the platform is rotatable around a vertical axis.

4. The eatery according to claim 1, wherein the top is transparent and made of an acrylic glass configured to allow for unimpeded observation of the environment and a projection wall.

5. An eatery having a seating area, the seating area having at least one table element and at least one seating element, wherein a moveable and accessible platform, on which the at least one table element and the at least one seating element are arranged, is provided, and wherein at least one elevation device for raising the platform is arranged in the area below the platform, wherein the platform is moveable between a basic position on ground level and a lookout position at a level elevated as compared to ground level, the eatery having a top supported by a plurality of struts which are anchored at their bottom ends in exterior wall elements, the plurality of struts are spaced apart along a circumference of the platform and connected at their top ends by an annular member, the annular member configured to accommodate a plurality of loudspeakers, wherein window areas are positioned between the plurality of struts, wherein the platform is rotatable around a vertical axis; an integrated cooling and heating system, wherein ventilation slots are integrated into the seating area of the at least one seating element; a circular stabilizing disc used to secure the platform against tilting; a touch screen for the placements of orders, wherein the platform is configured to raise in response to an order being received, wherein the at least one elevation device is formed by a telescopic cylinder that can be pushed in and pulled out along a central vertical axis.

6. An eatery having a seating area, the seating area having at least one table element and at least one seating element, wherein a moveable and accessible platform, on which the at least one table element and the at least one seating element are arranged, is provided, and wherein at least one elevation device for raising the platform is arranged in the area below the platform, wherein the platform is moveable between a basic position on ground level and a lookout position at a level elevated as compared to ground level, the eatery having a top supported by a plurality of struts which are anchored at their bottom ends in exterior wall elements, the plurality of struts spaced apart along a circumference of the platform and connected at their top ends by an annular member, wherein window areas positioned between the plurality of struts; the eatery having a circular stabilizing disc used to secure the platform against tilting.

* * * * *